United States Patent [19]

Fairchild

[11] 4,383,631

[45] May 17, 1983

[54] TENSIONING CONTROL DEVICE

[76] Inventor: Wayne K. Fairchild, 3620 W. Pendleton Ave., Santa Ana, Calif. 92704

[21] Appl. No.: 260,403

[22] Filed: May 4, 1981

[51] Int. Cl.[3] ..... B65H 17/22; B65H 59/12

[52] U.S. Cl. ..... 226/186; 242/151

[58] Field of Search ..... 226/186, 187; 292/75.2, 292/151

[56] References Cited

U.S. PATENT DOCUMENTS

| | | | |
|---|---|---|---|
| 767,640 | 8/1904 | Fredenburgh | 226/187 |
| 2,788,209 | 4/1957 | Montijo | 226/186 |
| 2,909,341 | 10/1959 | Kingsley | 226/186 X |
| 3,141,593 | 7/1964 | Selsted | 226/187 X |

*Primary Examiner*—Edward J. McCarthy
*Attorney, Agent, or Firm*—Francis X. LoJacono

[57] ABSTRACT

A tensioning device to control the dispensing of a large roll of ribbon or tape under a uniform tension as the roll becomes smaller in diameter. The tensioning device comprises a rotatably supported spool that is fixedly positioned and an adjustable roller mounted to a pivot arm, whereby the roller is positioned contiguously with respect to the fixed spool, the ribbon or tape being interposed therebetween. The roller includes an outer pliable frictional cylinder which is rotatably supported on the shaft mounted to the pivot arm in a vise-like arrangement, whereby the frictional cylinder can be squeezed to cause the outer diameter thereof to be adjusted to the proper frictional engagement with the ribbon or tape.

6 Claims, 5 Drawing Figures

TENSIONING CONTROL DEVICE

BACKGROUND OF THE INVENTION

1. Field of the Invention

This invention relates generally to a tensioning device, and more particularly to a device that applies a uniform pressure to ribbon or tape as the ribbon is being dispensed at various speeds from a large roll.

2. Description of the Prior Art

Several problems and difficulties are being encountered in providing suitable means for the uniform dispensing of ribbon or tape wound onto large rolls. It is very difficult to dispense a large roll of ribbon under a uniform tension as the roll decreases in size.

Ribbons or tapes are required in the manufacturing of several tubular products—the most common use being the forming of continuous flexible tubings of various sizes and lengths. These flexible tubings can be made from several types of ribbon or tape material, such as P.V.C., metalized milar, aluminum foil, titlar, P.V.C.-coated fiberglass, etc.

Accordingly, these rolls of ribbon are generally provided in a free form so that the ribbon is wound to form a large continuous spool that is mounted on or adjacent the tube-producing machine.

Various means and methods have been provided for continuously producing flexible tubing in endless lengths, such as disclosed in U.S. Pat. Nos. 3,271,064; 3,155,559 and 3,778,327.

Apparatuses of this type have an inherent problem in that they lack a means to control the feeding of the ribbon or tape from a roll to the machine in a manner whereby the tension is always uniform, regardless of the diameter of the roll. It is well established that, in the dispensing of the large-diameter rolls of ribbon, the tension is affected as the diameter is reduced while the ribbon is being unwound. If at any time the proper tension is not provided, the tubing can be improperly formed.

Therefore, the herein-disclosed device has been designed to overcome the above-mentioned problems in a very simple manner.

SUMMARY AND OBJECTS OF THE INVENTION

There is herein disclosed a new and improved device to establish a uniform controlled tensioning for ribbons or tapes used to form flexible continuous tubing.

It is, therefore, an important object of the present device to provide a tensioning means that will control the dispensing of a roll of tape or ribbon by causing a continuous controlled frictional engagement thereon by interposing the tape between a fixed rotatable spool and a contiguously positioned frictional roller, the frictional roller being mounted to a pivot arm, and being provided with an outer pliable cylinder that is compressible to cause a change in its diameter.

Another object of the present invention is to provide a tensioning means of this character that includes a vise-like mechanism, so as to allow the roller to be adjusted for the proper firctional engagement to conform to the particular dispensing speed.

Still another object of the invention is to provide a device of this character that is compatible with other types of manufacturing machines that produce various products which must be fabricated with continuous ribbons or tapes.

It is still another object of the invention to provide a device of this character that includes relatively few operating parts, making it easily adjustable.

Still another object of the present invention is to provide a tensioning device of this type that is relatively inexpensive to manufacture, and that is simple to operate, service and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
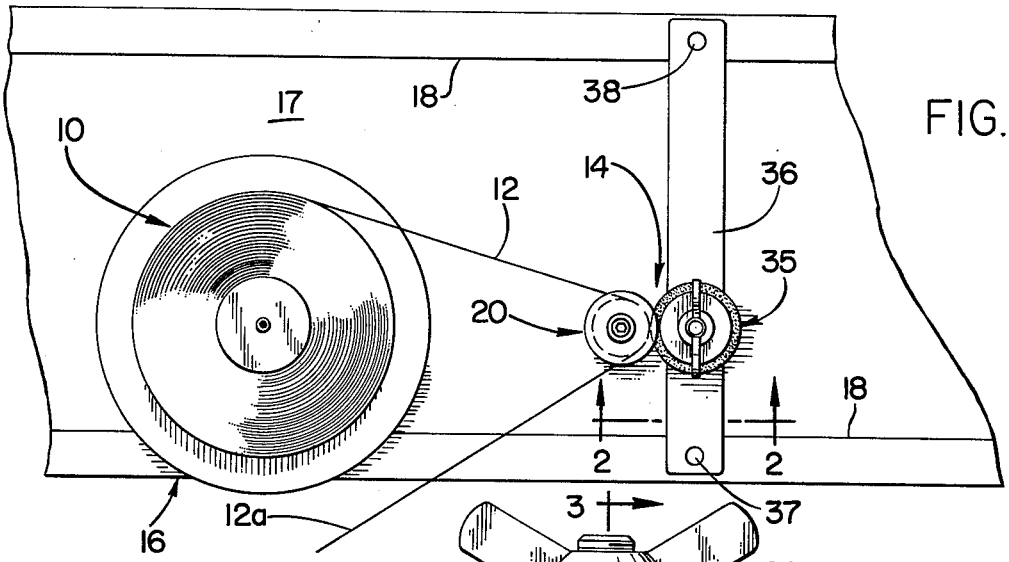
FIG. 1 is a top-plan view of the present invention shown supported on a fixed frame structure and having a roll of ribbon arranged to be frictionally engaged therewith.

Referring more particularly to FIG. 1, there is shown a roll or spool 10 of continuous ribbon or tape 12 which may be made in various widths, and from one of many types of material such as plastic or metal foil.

As previously mentioned, tapes or ribbons 12 of this character are generally used in fabricating several types of continuous flexible tubing, sometimes referred to as flexible hose or ducting. Accordingly, tape 12 is fed into a machine designed to create an indefinite length of flexible tubing; and the machine includes a mandrel upon which tape 12 and spring wire are wound and bonded together to form the tubing.

During an operation of this type, it is necessary to control the unwinding of the roll of tape 10 to prevent an excess amount of tape from being fed into the machine. Thus, a frictional tensioning device is needed and is herein generally indicated at 14, shown mounted to a fixed structure 16 defined by a platform 17 and frame members 18.

It should be noted that the roll of ribbon and the tensioning device 14 should be located on or adjacent the tube-fabricating machine (not shown), and can be mounted in either a vertical or a horizontal plane.

Accordingly, the tape or ribbon tensioning-control device 14 comprises a spool designated at 20 having a main cylindrical body 22, the body being formed from any suitably firm material, but preferably a light metal, the main body 22 including annular end flanges 24.

Figure 2:
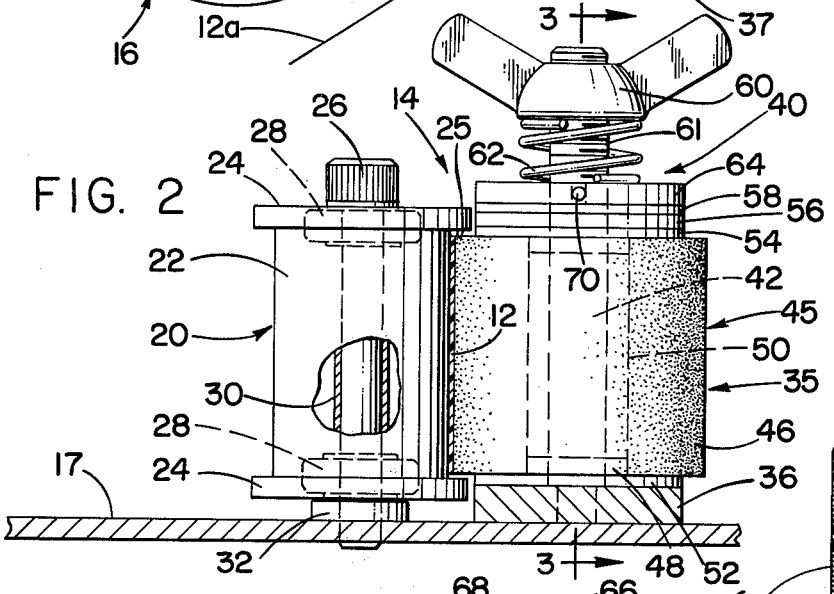
FIG. 2 is an enlarged cross-sectional view taken substantially along line 2—2 of FIG. 1.
Figure 4:
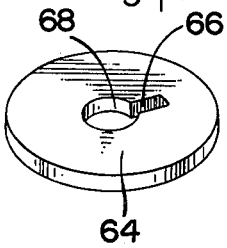
FIG. 4 is a perspective view of the slotted washer used to apply the compression on the outer cylinder.

Thus, an annular channel 24 is defined by flanges 24. The channel should have a width that is compatible with the width of the ribbon 12, so as to accept the ribbon therebetween as shown in FIG. 2.

Spool 20 is fixedly secured to platform 17 by means of bolt 26 which is threaded to platform 17. However, spool 20 is rotatably supported on bolt 26 by bearing means 28 fitted at each end of the main body 22, the bearings 28 being interconnected by bearing sleeve 30. Hence, body 22 is allowed to freely rotate about bolt 26 which defines a fixed axial pin. A spacer 32 is interpositioned between the bottom bearing 28 and platform 17 of structure 16. Spacer 32 is employed to provide the alignment between channel 25 of spool 20 and the adjacent frictional roller means, generally indicated at 35.

Frictional roller means 35 is adjustably mounted to a positioning means defined by a pivot arm 36, the arm being pivotally attached to frame 18 by pivot pin 37 located in one end of the arm 36. The opposite end of arm 36 is provided with a removable lock pin 38, or any other suitable locking means.

When ribbon or tape 12 is to be positioned in channel 25, lock pin 38 is removed from the aligned holes in frame 18 and arm 36, allowing arm 36 along with roller means 35 to be rotated to one side. Ribbon 12 is then positioned within channel 25 and the arm is returned to a locked or fixed position so as to engage ribbon 12, as seen in FIG. 2.

Because of the various thicknesses of the many different types of ribbons or tapes, the frictional roller means is provided with an adjustable compression means, indicated at 40. The frictional roller means comprises an axial pin 42 secured to arm 36 in a suitable manner, such as shown in the cross-sectional view of FIG. 3. Pin 42 is threadably received in threaded aperture 44 formed in arm 36 and adapted to receive a frictional roller 45 thereon.

Frictional roller 45 is formed with an outer pliable cylinder 46 having a center longitudinal bore 48 formed therein to receive bearing sleeve 50. Bearing sleeve 50 is shorter than bore 48, thus allowing cylinder 46 to be compressed by compression means 40, whereby the outer diameter of roller 45 can be increased to frictionally engage ribbon 12.

Positioned between the bottom of roller 45 and arm 36 is a washer 50, preferably composed of a plastic material, such as "Teflon". Thus, cylinder 46 is prevented from contacting arm 36 and is free to rotate with washer 52. The upper end of roller 45 is engaged by compression means 40 which comprises a first plastic washer 54 positioned on top of cylinder 46, and a second bronze washer 56 and a third washer 58 formed from a plastic material. Various arrangements of washers can be substituted; however, the above arrangement allows free rotation of the roller 45, and provides an even downward force when torque is applied to wing nut 60.

Wing nut 60 is threadably received on the free threaded end 61 of pin 42, and is provided with a coil spring 62 which is positioned between nut 60 and pressure plate 64.

Figure 3:
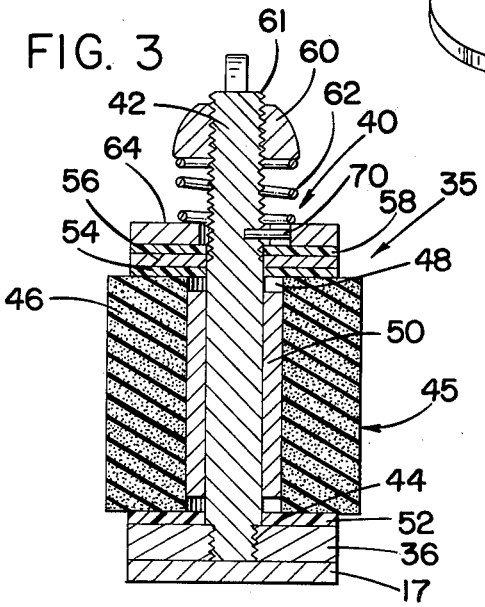
FIG. 3 is a cross-sectional view of the adjustable roller taken substantially along line 3—3 of FIG. 2.

In order to provide the necessary downward pressure on plate 64 without allowing the plate to rotate, there is included a means to hold and prevent the plate from rotating about pin 42, and yet allow the plate to move vertically thereon. Thus, the holding means comprises a slot 66 which extends radially outward from center hole 68, the slot being adapted to receive the laterally extended pin 70. Pin 70 is fixedly mounted to axial pin 42, as seen in FIG. 3.

The adjustment of nut 60 will cause a compression force between the upper washers and the lower washer 52 and arm 36. The pliable material of the cylinder 46 will thus be forced outwardly, engaging ribbon 12 and forcing it against spool 20. This arrangement allows the leading strand portion **12*a* to be under a controlled tension as it feeds onto the fabricating machine; and it further controls the rotation of the roll of ribbon 10**.

To further allow for a smooth dispensing of ribbon 12, it is contemplated that roll 10 will be mounted to a flat plate formed from a friction-free material such as "Teflon".

Figure 5:
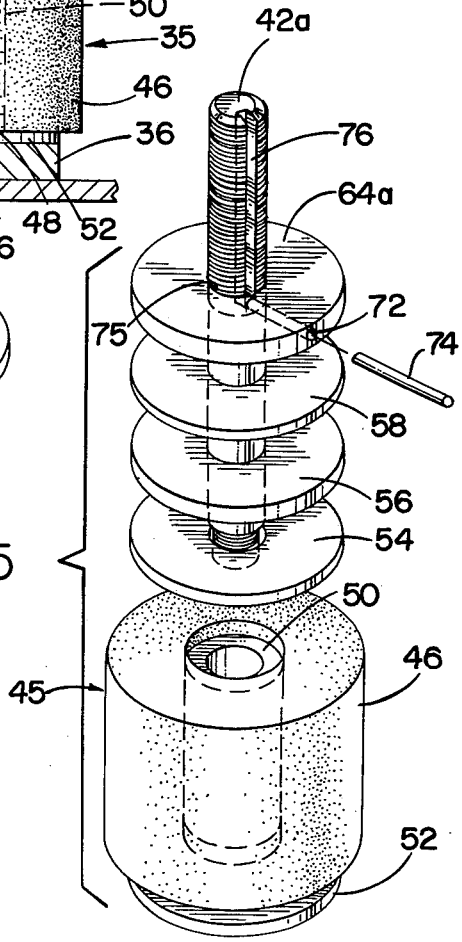
FIG. 5 is an exploded view of an alternative arrangement of the present invention.

A second embodiment of the present invention is disclosed and illustrated in FIG. 5, wherein the frictional roller means 35 comprises all the mentioned elements, with the exception that the holding means comprises a pressure plate **64*a* which includes a radial bore 72 adapted to receive dowel pin 74. Dowel pin 74 is positioned in plate 64*a*, so that it extends inwardly into the center hole 75 and is readily positioned into the vertically disposed groove 76 formed in the upper end of axial pin 42*a***.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A tensioning control device for the dispensing of a continuous roll of ribbon or tape under uniform tension, comprising:

a spool mounted to a fixed structure to rotate about its axis;

a frictional roller means mounted to be adjustably positioned relative to said spool, whereby said ribbon or tape is interposed therebetween;

means for adjustably positioning said frictional roller means contiguously with said spool, wherein said adjustable positioning means comprises an elongated arm member having one end thereof pivotally attached to said fixed structure, the opposite end thereof including a locking means to lock said frictional roller means in place adjacent said spool; and means for compressing said frictional roller means for controlled frictional engagement with said ribbon or tape, when positioned between said spool and said frictional roller means.

2. A tensioning control device as recited in claim 1, wherein said frictional roller means comprises:

an axial pin affixed to said pivotal arm member; and a cylindrical roller formed from a frictional pliable material adapted to be compressed by said compression means, in order to affect the diameter thereof.

3. A tensioning control device as recited in claim 2, wherein said compression means comprises:

at least one pair of washer members, each of said washers being positioned adjacent the opposite ends of said cylindrical roller;

a pressure plate having a central hole positioned over said axial pin, in order to move vertically thereon, thus engaging one of said washers;

means between said axial pin and said pressure plate for holding said pressure plate to prevent rotational movement; and means mounted to said axial pin for applying controlled pressure against said pressure plate.

4. A tensioning control device as recited in claim 3, wherein said means for holding said pressure plate from rotational movement comprises:

a dowel pin affixed to said axial pin and extending radially outward therefrom; and a slot formed in said pressure plate extending outwardly from said central hole therein, and adapted to receive said dowel pin.

5. A tensioning control device as recited in claim 3, wherein said means for holding said pressure plate from rotational movement comprises:

a dowel pin affixed within said pressure plate and positioned to extend within said central hole thereof; and a vertical groove formed in said axial pin adapted to receive said dowel pin for movement therein.

6. A tensioning control device as recited in claim 3, wherein said means for applying controlled pressure against said pressure plate comprises:

a nut member adapted to be threadably positioned on said axial pin; and a coil spring interposed between said nut member and said pressure plate.

* * * * *